US006338212B1

(12) United States Patent
Santa Cruz et al.

(10) Patent No.: US 6,338,212 B1
(45) Date of Patent: Jan. 15, 2002

(54) ADVERTISEMENT DISPLAY APPARATUS

(76) Inventors: Cathy D. Santa Cruz, 7630 Tholl Dr., Reno, NV (US) 89506; Richard Cancimilla, 2215 Green Vista Dr. #302, Sparks, NV (US) 69220

( * ) Notice: Subject to any disclaimer, the term of this patent is extended or adjusted under 35 U.S.C. 154(b) by 0 days.

(21) Appl. No.: 09/542,435

(22) Filed: Apr. 4, 2000

(51) Int. Cl.[7] ..... G09F 15/00
(52) U.S. Cl. ..... 40/607; 40/661; 40/611
(58) Field of Search ..... 40/606, 607, 611, 40/612, 661, 763, 764; 248/218.4

(56) References Cited

U.S. PATENT DOCUMENTS 1,603,311 A * 10/1926 Brett et al. ..... 40/607
1,674,005 A * 6/1928 Eschenbuch ..... 40/645
5,335,889 A * 8/1994 Hopkins et al. ..... 40/607 X
5,618,141 A * 4/1997 Field ..... 40/607 X
6,233,858 B1 * 5/2001 Brach, Jr. et al. ..... 40/607 X
6,253,478 B1 * 7/2001 Kalavity ..... 40/611 X

FOREIGN PATENT DOCUMENTS

GB 2100044 * 12/1982 ..... 40/607

* cited by examiner

*Primary Examiner*—Brian K. Green

(57) ABSTRACT

An advertisement display apparatus which is completely portable, self-contained, requires no installation tools, and is most efficient for display of signs.

14 Claims, 4 Drawing Sheets

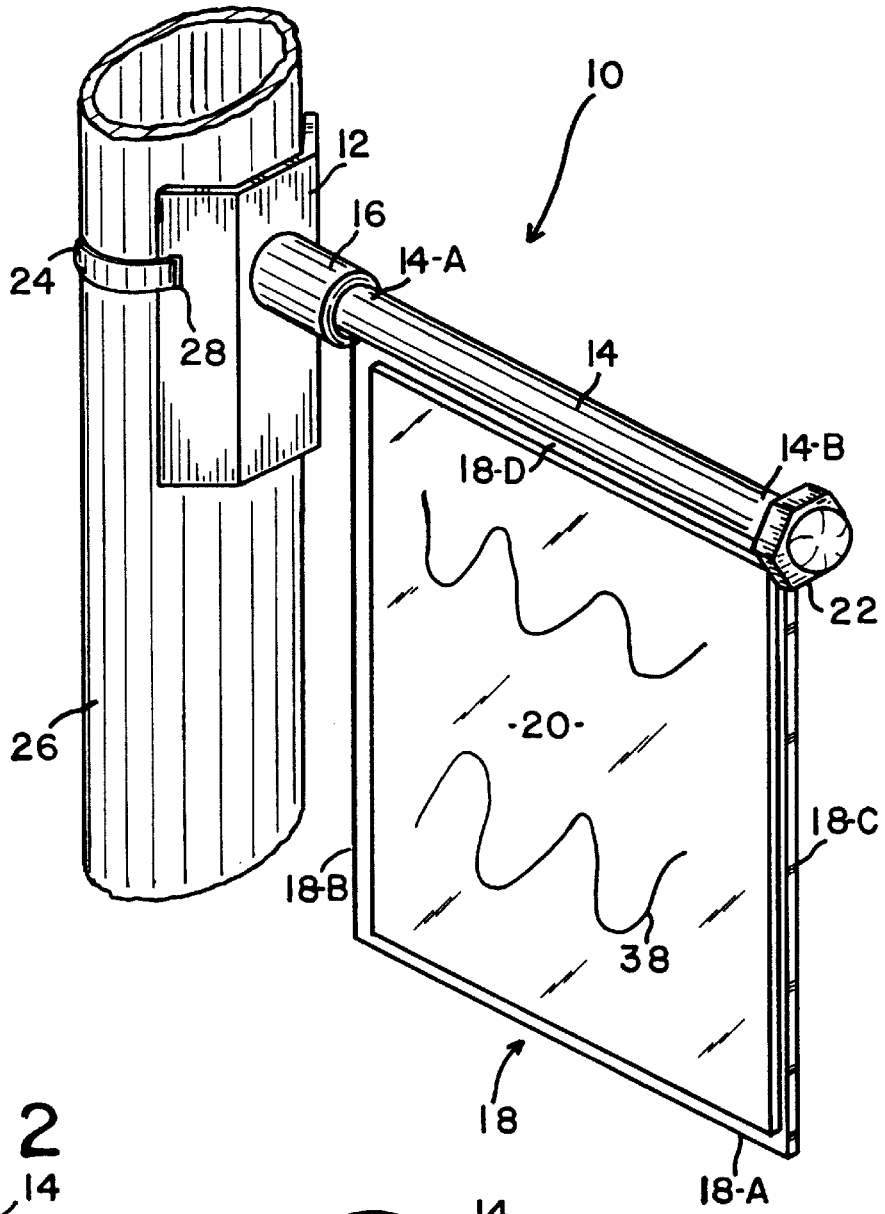
FIG. 1
FIG. 2
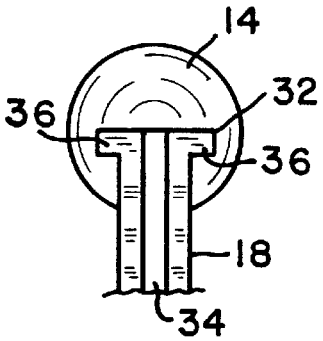
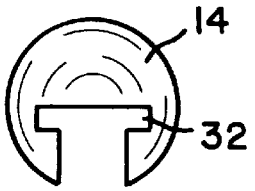
FIG. 3

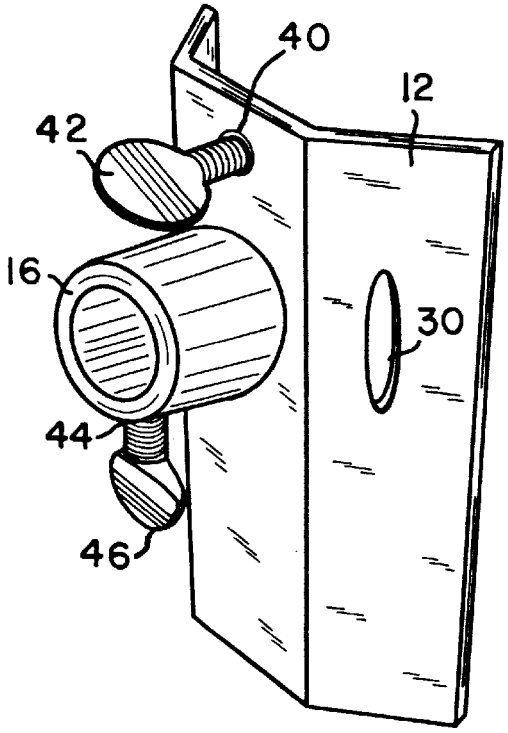
FIG. 4
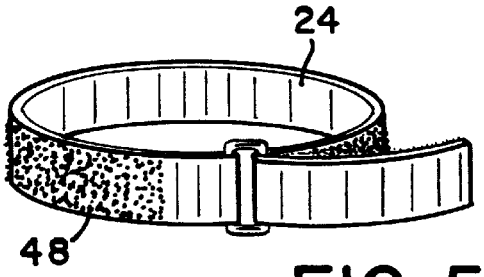
FIG. 5
FIG. 6
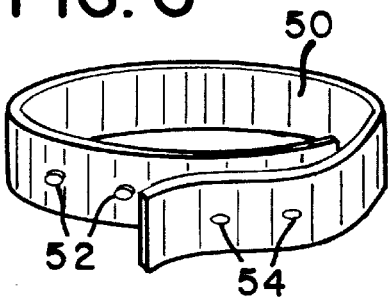

ADVERTISEMENT DISPLAY APPARATUS

FIELD OF THE INVENTION

This invention relates to portable stands such as typically used for display of advertising signs, but more particularly pertains a display apparatus which is removably attachable to a pre-existing support structure, such as a pole, a fence post, or the like. The apparatus requires no installation tools, is portable, includes a carrying case, and is easily assembled on location.

BACKGROUND OF THE INVENTION

In the past, many different types of devices have been used for display of advertisements. However, most devices are very complicated, use multiple brackets, bolts and nuts, and necessitate the need for unnecessary installation tools. Unfortunately, such devices have not found success in the market place because of inherent disadvantages, such as due to complex installation, are aesthetically not pleasing, most costly, and not easily installed.

Some examples of prior art include U.S. Pat. Nos. 5,836,558, 5,400,535, 5,930,926 and 5,911,525. Although each are somewhat functional for their intended use they still have innate problems, such as those mentioned above, which the present invention recognizes, addresses, and resolves in a manner heretofore not seen within the known prior art.

SUMMARY OF THE INVENTION

It is therefore an object of the present invention to provide an advertisement display apparatus that is completely portable and may be conveniently carried in a unique case.

Another object of the present invention is to provide an advertisement display apparatus which may is adjustably removably attached onto substantially any suitable upright support structure of end users's choice, such as a fence post, a pole, etc. or any other support structure which can be wrapped with a strap.

Still another object of the present invention is to provide an advertisement display apparatus which is easily assembled on location without the need for any installation tools.

Yet another object of the present invention is to provide an advertisement display apparatus which can be made from substantially any suitable material of engineering choice, such as wood, hardened rubber, fiberglass, plastic, nylon, etc.

A further object of the present invention is to provide an advertisement display apparatus which is inexpensive to manufacture, and very affordable for the consumer.

Still a further object of the present invention is to provide an advertisement display apparatus which may be color coded for easy assembly.

Yet a further object of the present invention is to provide an advertisement display apparatus which is completely safe to use.

Also a further object of the present invention is to provide an advertisement display apparatus which is environmentally friendly as it can be made from recycled materials.

Another object of the present invention is to provide an advertisement display apparatus which allows a user to easily change the display sign according to their needs.

Still another object of the present invention is to provide an advertisement display apparatus which is aesthetically pleasing to the eye, and is viewable from opposing directions.

Yet a further object of the present invention is to provide an advertisement display apparatus which is completely weather proof and protects the sign from external elements.

Also another object of the present invention is to provide an advertisement display apparatus which may include an elongated weighted clip which eliminates excessive undesirable swinging of the sign, such as incurred on windy days.

Yet another object of the present invention is to provide an advertisement display apparatus which may include an accessory compartment for containment of paraphernalia pertinent to the advertisement therewith, such as catalogs, sales sheets, etc.

Still a further object of the present invention is to provide an advertisement display apparatus which may be sold as a complete kit in a carrying case with accessories. The accessories including the above noted weighted clip, the accessory compartment, and a stake which functions as the support structure. It is to be noted the stake can be made from any suitable material of engineering choice, such as from PVC pipe, or the like.

Another object of the present invention is to provide an advertisement display apparatus which can be manufactured in various sizes of engineering choice, so as to be functional with different sized support structures.

Other objects and advantages will be seen when taken into consideration with the following specification and drawings.

BRIEF DESCRIPTION OF THE DRAWINGS

FIG. 1 is substantially a perspective overview for the preferred embodiment of the present invention.

FIG. 2 is substantially an end view of a support rod having the open top end of a display holder slidably engaged therein.

FIG. 3 is substantially an end view of the support rod.

FIG. 4 is substantially a perspective view of a bracket.

FIG. 5 is substantially a perspective view of one embodiment for a strap.

FIG. 6 is substantially a perspective of a different embodiment for the strap.

DETAILED DESCRIPTION OF THE DRAWINGS

Figure 8:
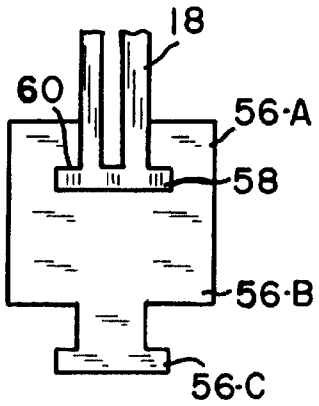
FIG. 8 is substantially an end view of FIG. 7.
Figure 7:
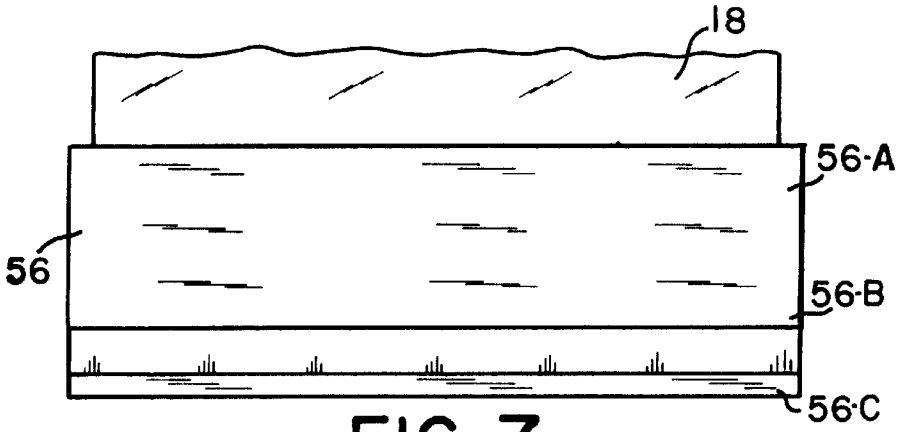
FIG. 7 is substantially a partial front view of an elongated weighted clip when attached to the display holder.
Figure 10:
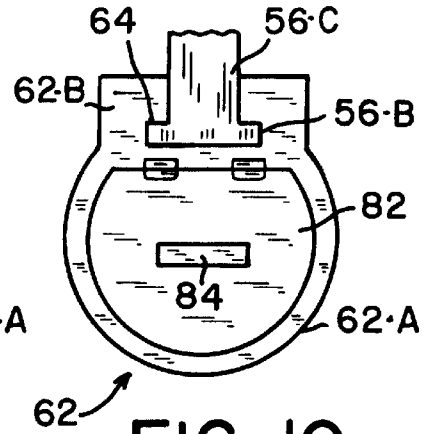
FIG. 10 is substantially an end view of FIG. 9.
Figure 9:
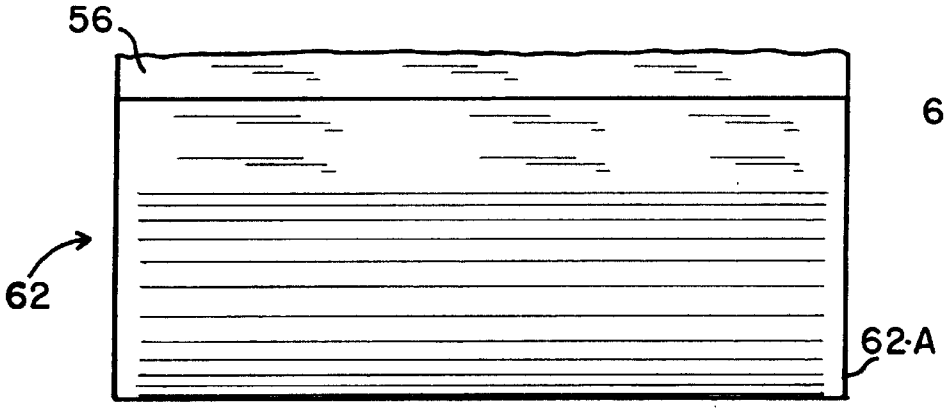
FIG. 9 is substantially a partial front view of a paraphernalia compartment when attached to the weighted clip.

Referring now to the drawings wherein like characters refer to like elements throughout the various views. In FIG. 1, arrow (10) represents a general overview for the preferred embodiment of the present invention, which is an advertisement display apparatus.

As will be seen, apparatus (10) is of simple construction and includes very few components, namely, a bracket (12), a support rod (14), a support rod receptacle (16), a transparent advertisement display holder (18), a sign (20), an end cap (22) and a strap (24).

Illustrated in FIG. 1, we show apparatus (10) being removably attached onto a support structure (26). It is to be noted that any suitable support structure of user choice may be used, such as a fence post, a telephone pole, a pipe, etc. and thus the present invention is not to be limited to any specific type of support structure.

Referring now to bracket (12), which can be made from substantially any suitable material of engineering choice. For example, wood, metal, aluminum, etc., or as the applicants prefer, plastic is the favored material of choice. Bracket (12) having adjustable attachment means for removably adjustably attaching bracket (12) onto support structure (26). It is to be understood any suitable attachment means of engineering choice may be used, such as bracket (12) may include a first aperture (28) as shown in FIG. 1 and a second aperture (30) as shown in FIG. 4. With first aperture (28) being substantially opposed to second aperture (30) and each aperture (28 & 30) being of a shape and size to slidably receive a strap (24) there through. It is to be noted various types of straps of engineering choice may be used but this is to be addressed later on herein.

Furthermore, bracket (12) includes attachment means of engineering choice for receiving and securing support rod (14) thereon. Such as illustrated in FIG. 1, bracket (12) is formed from plastic mold injection with support rod (14) being integrally formed with said bracket, and support rod receptacle (16) is of a shape and size to slidably frictionally removably receive first end (14-A) of support rod (14) therein.

With regard to support rod (14), it is to be understood any suitable material of engineering choice may be used to form support rod (14), such as plastic or the like. Support rod (14) having a first end (14-A), a second end (14-B), and an elongated receiving channel (32).

Referring now to transparent advertisement display holder (18) which includes a closed bottom end (18-A), two closed sides (18-B & 18-C), and a top end (18-D), which in combination form an interior cavity (34), with open top end (18-D) having a protruding lip (36). It will now be seen transparent display holder (18) can be easily inserted into elongated receiving channel (32), as receiving channel (32) is of a shape and size to slidably receive protruding lip (36) therein.

It will now be seen that sign (20) can be easily inserted or removed from display holder (18) as cavity (34) is of a shape and size to slidably receive sign (20) therein. It will also be seen sign (20) when secured within display holder (18) is protected from external elements, as end cap (22) is of a shape and size to be slidably frictionally removably attached onto second end (14-B) of support rod (14). It is to be noted other types of attachment means of engineering choice may be used for securing support rod receptacle (16) and end cap (22) onto support rod (14), such as by threads or the like.

It is to be understood the above described apparatus (10) is fully functional as is and allows a user to easily install the apparatus (10) without any tools of any kind. Also this embodiment is completely portable, self-contained and allows the user to easily insert or remove sign (20) from within display holder (18). It is to be understood any sign of end user's choice may be used, such as "FOR SALE", "GARAGE SALE", etc. It will further be seen that when sign (20) is inserted into display holder (18) indicia (38) is clearly visible from two opposing directions, as display holder (18) is transparent. Although the previously described embodiment is functional, it may be desirable to include various models, such as follows.

As illustrated in FIG. 4, bracket (12) may further include additional securing means, such as a threaded aperture (40) which is of a shape and size to threadably receive a threaded thumb screw (42) therein. This serves to reinforce bracket (12) onto support structure (26), as screw (42) can be hand tightened until bracket (12) is tensioned against support structure (26).

Still further for increased stability, support rod receptacle (16) may also include a threaded aperture (44), which is of a shape and size to threadably receive a threaded thumb screw (46) therein. Thus support rod (14) when frictionally engaged within support rod receptacle (16), may be further secured in place when screw (46) is hand tightened until tension is applied onto support rod (14).

As stated earlier, bracket (12) can be removably attached onto support structure (26) by any suitable attachment means of engineering choice. Thus in FIGS. 5 & 6 we show various types of straps with each having individual characteristics. For example in FIG. 5, we show a strap (24) having adjustable closure means of the loop and pile variety (48). This type of strap is most functional as it is completely adjustable and of simple construction. While in FIG. 6, we show a different type of strap (50), wherein the adjustable closure means includes strap (50) having multiple protruding teats (52) and at least one hole (54). With hole (54) being of a shape and size to frictionally retain one of the multiple teats (52) therein. Thus again providing a closure means that is completely adjustable and very functional for the intended use. However, if further support is desirable, an additional wing nut (not shown) such as previously described may be threadably inserted into hole (54) and apply tension onto support structure (24).

If so desired, apparatus (10) may further include additional accessories depending on user choice. Such as apparatus (10) may have a removably attached elongated weighted clip (56) as illustrated in FIGS. 7–10. Wherein clip (56) has a top end (56-A) and a bottom end (56-B). With closed bottom end (18-A) of display holder (18) having an elongated protruding lip (58), and top end (56-A) of clip (56) having an elongated internal receiving channel (60) which is of a size and shape to slidably receive elongated protruding lip (58) therein. It is to be noted clip (56) can be made of any suitable material of engineering choice, such as steel or the like, which provides sufficient weight to reduce undesirable swinging of sign (20). It is to be also understood that clip (56) can be formed with only channel (60) for receiving elongated lip (56-A) therein, or it may further include on bottom end (56-B) a protruding lip (56-C) which may be used for attachment of an additional accessory as follows.

In many cases, it may be desirable to include a removably attached paraphernalia compartment (62) which allows a user to insert pertinent information relating to indicia (38) displayed on sign (20). For example, if the sign (20) is used for real-estate purposes for sale of a home, paraphernalia compartment (62) may include pamphlets describing the home, and this allows passerby's to easily remove and take the pamphlet for later reading.

Paraphernalia compartment (62) includes a cylindrical body portion (62-A), and a top portion (62-B). With top portion (62-B) of paraphernalia compartment (62) having an elongated receiving channel (64) which is of a shape and size to slidably receive either protruding lip (56-C) of clip (56), or protruding lip (58) of display holder (18). Whereby, apparatus (10) can be used with either elongated weighted clip (56) or with paraphernalia compartment (62). Or apparatus (10) may be used with both weighted clip (56) and paraphernalia compartment (62) in combination. Also if preferred paraphernalia compartment (62) may further include closure means of engineering choice. Such as either end or both ends of paraphernalia compartment (62) may include a hinged closure cap (82) having a handle (84) thereon. This not only protects the paraphernalia therein but allows a user to easily open the compartment.

Other unique characteristics for the present invention may include apparatus (10) being color coded for easy assembly, depending on engineering or user preferences.

Figure 12:
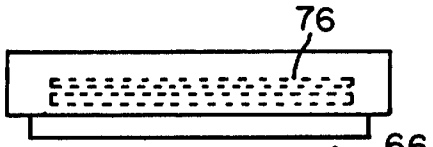
FIG. 12 is substantially a side view of a carrying case for the present invention.
Figure 13:
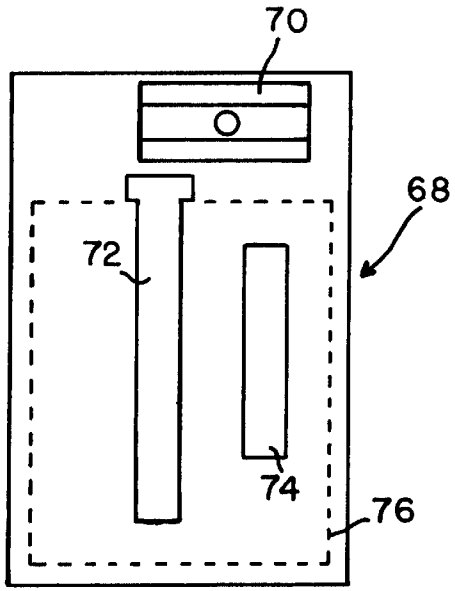
FIG. 13 is substantially a top view of the carrying case when in an open position.

Still another accessory for the present invention may include a unique carrying case as depicted in FIGS. 12 & 13. Wherein we provide a carrying case (66) which can be made from any suitable material of engineering choice, such as plastic, wood, cardboard, etc., and includes within the interior a STYROFOAM insert (66) or the like. With STYROFOAM insert (66) having molded compartments for securing each of the components of apparatus (10) therein. Such as a bracket compartment (70), a support rod and cap compartment (72), a strap compartment (74), and multiple internal compartments (76) for slidably receiving either sign (20) or display holder (18) therein. It is to be noted carrying case (66) is not to be limited to this embodiment as this is only exemplary. Also it may further include additional compartments for other accessories.

Figure 11:
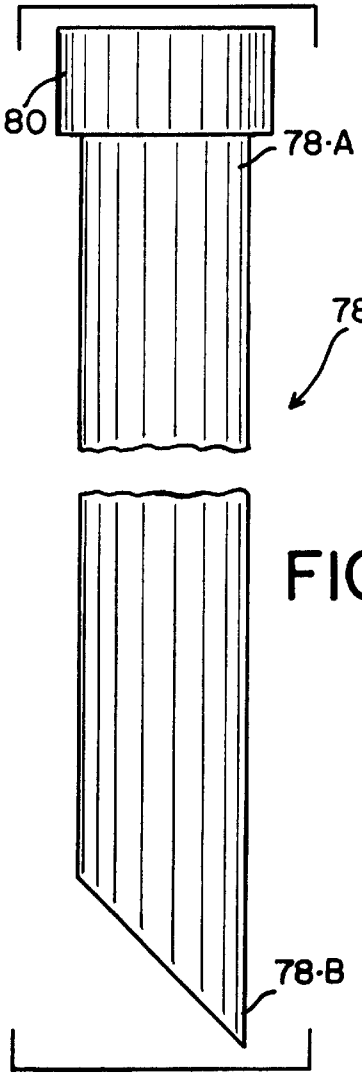
FIG. 11 is substantially a side view of a spike.

It is to be understood that any support structure (26) of user choice may be used, or if preferred the present invention may include its own support structure. Such as illustrated in FIG. 11, the support structure may be in the form a PVC pipe (78) having a top end (78-A) and a bottom end (78-B). With top end (78-A) having a removable end cap (80) and bottom end (78-B) being formed into a spike.

It can now be seen we have herein provided an advertisement display apparatus which is of simple construction, is completely portable, requires no installation tools, and includes various unique accessories heretofore not taught within the known prior art.

We further provide a unique method for using the present invention as follows:

A method for using an advertisement display apparatus comprising the steps of:

a. locating a suitable support structure (26);

b. positioning a bracket (12) at a desired location on support structure (26);

c. attaching bracket (12) onto support structure (26) using a strap (24);

d. adjusting strap (24) until bracket (12) is secure;

e. affixing strap (24) in place;

f. grasping a support rod (14);

g. inserting support rod (14) into a support rod receptacle (16);

h. inserting a sign (20) into a transparent advertisement display holder (18);

i. inserting transparent advertisement display holder (18) into an elongated receiving channel (32) formed in support rod (14); and;

j attaching an end cap (22) onto support rod (14).

Although the invention has been herein shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus.

Having described the invention what we claim as new and wish to secure by Letters Patent is:

1. An advertisement display apparatus which is removably attachable to a support structure, said apparatus comprising: a bracket; a support rod; a support rod receptacle; a transparent advertisement display holder; a sign; and an end cap; said bracket having adjustable attachment means for removably adjustably attaching said bracket to said support structure, said support rod having a first end, a second end and an elongated receiving channel, said support rod receptacle being of a shape and size to slidably frictionally removably receive said first end of said support rod therein, said transparent advertisement display holder having a closed bottom end, two closed sides, and an open top end which form an interior cavity, said open top end having a protruding lip, said elongated receiving channel being of a shape and size to slidably receive said protruding lip therein, said cavity being of a shape and size to slidably receive said sign therein, and said end cap being of a shape and size to be slidably frictionally removably attached onto said second end of said support rod.

2. The apparatus of claim 1 wherein said adjustable attachment means for removably adjustably attaching said bracket to said support structure comprising: said bracket having a first and a second aperture, said first aperture being opposed to said second aperture, each said aperture being of a shape and size to slidably receive a strap there through, and said strap having adjustable closure means thereon.

3. The apparatus of claim 2 wherein said adjustable closure means is of the loop and pile variety.

4. The apparatus of claim 2 wherein said adjustable closure means includes said strap having multiple protruding teats and a hole, and said hole being of a shape and size to frictionally retain one of said multiple teats therein.

5. The apparatus of claim 1 wherein said bracket further includes a threaded aperture for threadably receiving a threaded thumb screw therein.

6. The apparatus of claim 1 wherein said support rod receptacle further includes a threaded aperture for threadably receiving a threaded thumb screw therein.

7. The apparatus of claim 1 further having a removably attached elongated weighted clip; said clip having a top end and a bottom end, said closed bottom end of said display holder having an elongated protruding lip; and said top end of said clip having an elongated internal receiving channel which is of a size and shape to slidably receive said elongated protruding lip therein.

8. The apparatus of claim 7 further includes a removably attached paraphernalia compartment having a cylindrical body portion and a top portion, said bottom end of said clip having a protruding lip, and said top portion of said paraphernalia compartment having an elongated receiving channel which is of a shape and size to slidably receive either said protruding lip of said display holder or said protruding lip of said clip.

9. The apparatus of claim 1 wherein said support rod receptacle is integrally formed with said bracket.

10. The apparatus of claim 1 is color coded for easy assembly.

11. The apparatus of claim 1 further includes a portable carrying case.

12. The apparatus of claim 1 is made from a plastic which has been injection molded.

13. An advertisement display apparatus comprising: a support structure; a bracket; a support rod; a support rod receptacle; a transparent advertisement display holder; a sign; and an end cap; said bracket having adjustable attachment means for removably adjustably attaching said bracket to said support structure, said support rod having a first end, a second end and an elongated receiving channel, said support rod receptacle being of a shape and size to slidably frictionally removably receive said first end of said support rod therein, said transparent advertisement display holder having a closed bottom end, two closed sides, and an open top end which form an interior cavity, said open top end having a protruding lip, said elongated receiving channel being of a shape and size to slidably receive said protruding lip therein, said cavity being of a shape and size to slidably receive said sign therein, and said end cap being of a shape and size to be slidably frictionally removably attached onto said second end of said support rod.

14. The apparatus of claim 13 wherein said support structure is a PVC pipe having a top end and a bottom end, said top end having a removable end cap, and said bottom end being formed into a spike.

* * * * *